US006881120B1

(12) United States Patent
Janes

(10) Patent No.: US 6,881,120 B1
(45) Date of Patent: Apr. 19, 2005

(54) TOY FACE WITH NOISE MAKING TONGUE

(76) Inventor: Timothy T. Janes, 4921 Marine Ave., Lawndale, CA (US) 90260

( * ) Notice: Subject to any disclaimer, the term of this patent is extended or adjusted under 35 U.S.C. 154(b) by 0 days.

(21) Appl. No.: 10/794,986

(22) Filed: Mar. 5, 2004

Related U.S. Application Data

(60) Provisional application No. 60/452,611, filed on Mar. 6, 2003.

(51) Int. Cl.[7] ..... A63H 13/00

(52) U.S. Cl. ..... 446/200; 446/205; 446/397; 206/457

(58) Field of Search ..... 446/176, 213, 446/216, 198, 199, 200, 202, 204, 205, 397, 207; 206/223, 579, 457, 471; 40/906, 124.03; 472/51–53, 56; D21/405, 411, 659

(56) References Cited

U.S. PATENT DOCUMENTS 530,909 A * 12/1894 Stone ..... 446/204
917,971 A * 4/1909 Elliot et al. ..... 417/372
2,665,003 A * 1/1954 Feigelman ..... 206/457
3,071,892 A * 1/1963 Clark ..... 446/199
4,291,704 A * 9/1981 Petty et al. ..... 600/541
4,798,313 A * 1/1989 Farley ..... 222/192
5,110,316 A * 5/1992 Shaw et al. ..... 446/202
D458,313 S * 6/2002 Walsh ..... D21/398

* cited by examiner

*Primary Examiner*—Bena B. Miller
(74) *Attorney, Agent, or Firm*—Edgar W. Averill, Jr.; Kenneth L. Green

(57) ABSTRACT

A noise maker includes a face piece, a blow tube, and noise making tongue. The face piece may be a small planar representation of a face or of a portion of a face if a clown, monster, cartoon character, or the like, and may be made from cardboard or plastic. The blow tube extends inwardly from the face piece and the tongue extends outwardly from the face piece. The blow tube includes a tube passageway running the length of the blow tube, and the tongue includes a tongue passage running the length of the tongue. Blowing into the blow tube results in producing a raspberry noise at an opening end of the tongue. A lanyard may be attached to the face for carrying.

26 Claims, 7 Drawing Sheets

TOY FACE WITH NOISE MAKING TONGUE

The present application claims the benefit of U.S. Provisional Application Ser. No. 60/452611, filed Mar. 6, 2003, which application is incorporated herein by reference.

BACKGROUND OF THE INVENTION

The present invention relates to noise makers, and in particular to a toy face having a noise making tongue.

Various activities such as play, parties, and celebrations, involve some form of noise making as part of the activity. In many cases, loud and obnoxious sounds add to the festive mood. Further, a plain whistle or other noise making device, for example, the Rubber Razzer distributed by Triple Play in Cleveland, Ohio, may detract from the mood associated with the occasion, and children in particular enjoy colorful, clown-like, or fantasy-like toy faces. Therefore, a need exists for a noise maker which is attractive to children and others. Also, commercialization motivated a construction allowing the noise maker to be packaged in a substantially flat retail packaging.

BRIEF SUMMARY OF THE INVENTION

The present invention addresses the above and other needs by providing a noise maker comprising a face piece, a blow tube, and noise making tongue. The face piece may be a small flat (or planar) representation of a clown, monster, cartoon character, or the like, and may be made from cardboard or plastic. The blow tube extends inwardly from the face piece and the tongue extends outwardly from the face piece. The blow tube includes a tube passageway running the length of the blow tube, and the tongue includes a tongue passageway running the length of the tongue. Suitably blowing into the blow tube results in producing a raspberry noise at an opening end of the tongue. For example, a user may vary the degree of blowing into the blow tube to determine a suitable degree of blowing to obtain the desired raspberry sound. A lanyard may be attached to the face for carrying.

In accordance with one aspect of the invention, there is provided a packaged noise maker comprising a packaging for retail sales, a face piece, a blow tube, and a tongue. The blow tube has a mouth end, a tongue end opposite the mouth end, and a tube passageway extending through the blow tube between the mouth end and the tongue end. The tongue is substantially flat and has an open end opposite a tube end, and a tongue passageway running from the tube end to the open end. The tube end of the tongue is affixed to the tongue end of the blow tube, and the affixed tongue and blow tube are insertable into an opening in face piece to assemble the noise maker. Suitably blowing through the blow tube causes a raspberry sound to be produced at the open end of the tongue.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
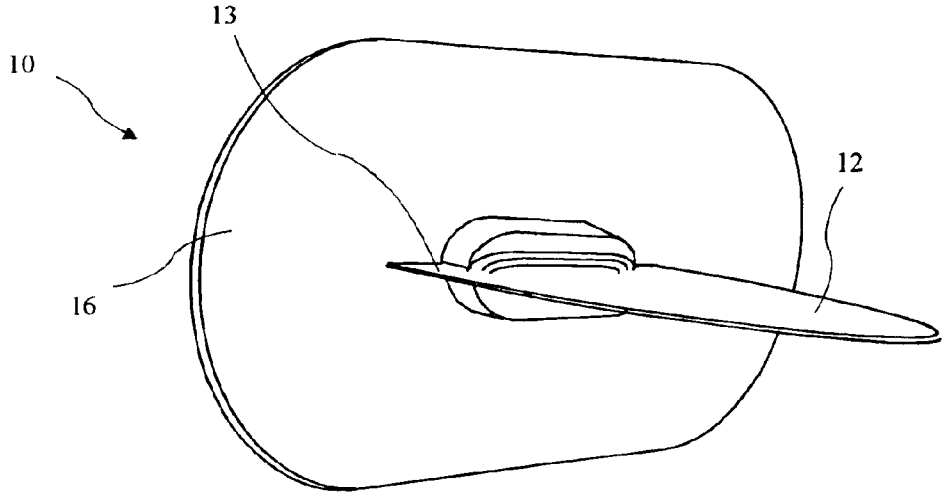
FIG. 1 is a perspective view of an assembled noise maker according to the present invention.
Figure 2A:
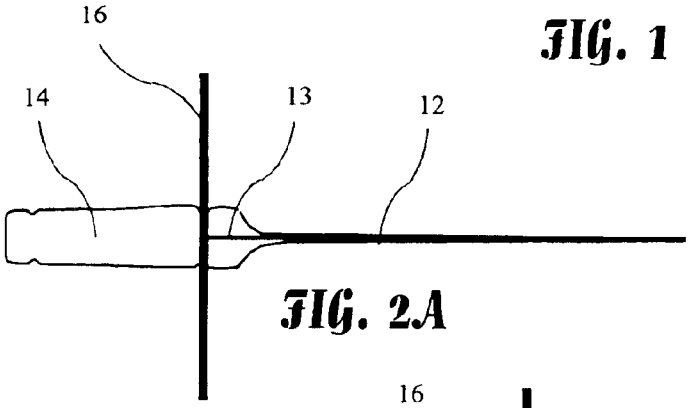
FIG. 2A shows a side view of the assembled noise maker.
Figure 2B:
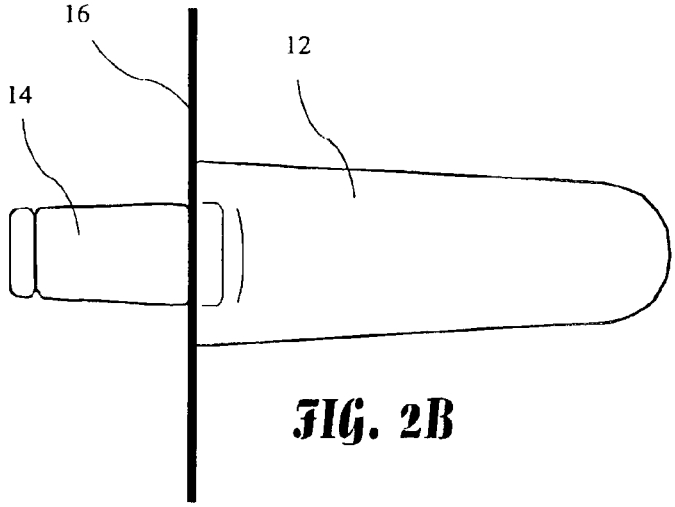
FIG. 2B shows a top view of the assembled noise maker.

The present invention provides a packagable, assemblable, noise maker 10 as shown in FIG. 1. The noise maker 10 includes a substantially oval face piece 16 with an outward protruding substantially flat tongue 12. The face piece 16 may have a shape facilitating the representation of a mouth, mouth and nose, mouth, nose, and chin, or face, to enhance the appearance of the face piece 16. The face piece 16 may be held in front of a user's mouth, and the user may blow into a blow tube 14 (see FIG. 2A) to make a raspberry sound. The face piece 16 is preferably between 2.5 inches and 5.5 inches high, and between three and 5.5 inches wide, and more preferably approximately 2.875 inches high, and approximately 4.25 inches wide. The face piece 16 is preferably flat (or planar), approximately 0.065 inches thick, and made from cardboard or plastic, and more preferable made from plastic. The tongue 12 further includes laterally extending flanged surfaces 13 providing a full tongue width appearance for the entire tongue 12. A side view of the assembled noise maker 10 is shown in FIG. 2A, and a top view in FIG. 2B.

Figure 3:
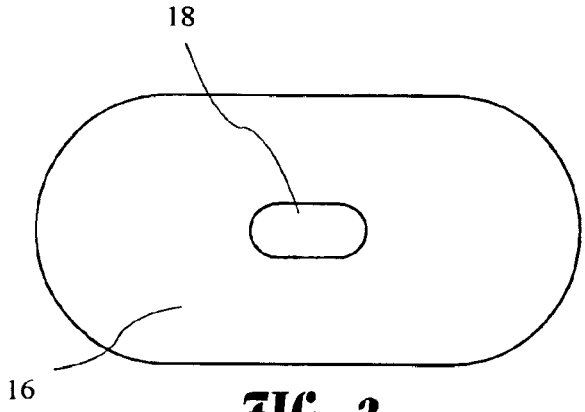
FIG. 3 shows a front view of a face piece component of the noise maker.

A front view of the face piece 16 is shown in FIG. 3. An opening 18 in the face piece 16 provides an interference fit to a tongue end 22 and/or a snap fit to a tongue end groove 22*a* (see FIG. 4B) of the blow tube 14 inserted therethrough, which opening 18 is preferably approximately centered in the face piece 16.

Figure 4A:
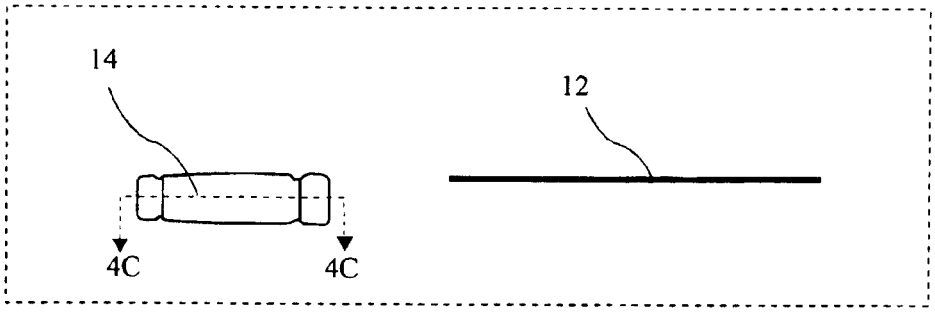
FIG. 4A is a side view of disassembled blow tube and tongue components of the noise maker.
Figure 4B:
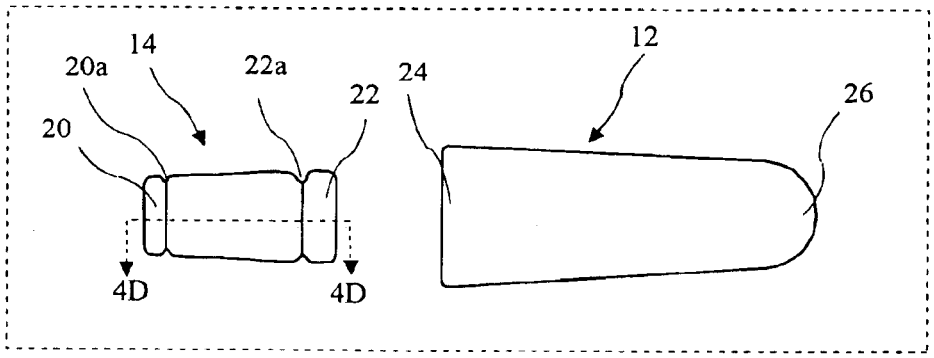
FIG. 4B is a top view of the disassembled blow tube and tongue components of the noise maker.

Detailed side views of the blow tube 14 and tongue 12 are provided in FIG. 4A, and detailed top views in FIG. 4B. A mouth end 20 of the blow tube 14 is opposite a tongue end 22, a mouth end groove 20*a* is proximal to the mouth end 20, and a tongue end groove 22*a* is proximal to the tongue end 22, and the blow tube 14 preferably has an oval cross-section and tapers down from the tongue end 22 to the mouth end 20. The mouth end groove 20*a* is preferable approximately 0.2 inches from the corresponding end of the blow tube 14, and the tongue end groove 22*a* is preferable approximately 0.25 inches from the corresponding end of the blow tube 14. The mouth end groove 20*a* may be held by the user's teeth to facilitate use of the noise maker 10. The tongue end groove 22*a* preferable cooperates with the opening 18 for a snap in fit of the blow tube 14 in the face piece 16, or the blow tube 14 may be held in the face piece 16 by an interference fit of the tongue end 22 with the opening 18. The blow tube 14 is preferably between one inch and two inches long, and the tongue end 22 of the blow tube 14 is preferably between one quarter inches and one half inches high, and is between one half inch and one inch wide. The blow tube 14 is preferably made from plastic.

A tube end 24 of the tongue 12 is opposite an open end 26 of the tongue 12. The tongue 12 is preferably between two inches and four inches long, the tube end 24 is preferably between 1.25 inches and 2.25 inches wide, and the tongue 12 open end 26 is preferably rounded having a radius of between 0.75 inches and 1.25 inches. The tongue 12 is more preferably approximately 2.5 inches long, approximately 1.5 inches wide at the tube end 24, and the tongue 12 open end 26 is more preferably rounded having a radius of approximately one inch. The tongue 12 is preferably affixed to the blow tube 14 by gluing the tongue 12 over the tongue end 22 of the blow tube 14. The tongue end 22 of the blow tube 14 is preferably an approximately one quarter inches long portion of the blow tube 14, and the tube end 24 of the tongue 12 is affixed to the tongue end 22 of the blow tube 14 wherein the tongue end 22 of the blow tube 14 is substantially covered by the tube end 24 of the tongue 12. The affixed tongue 12 and blow tube 14 are insertable into the opening 18 in face piece 16 to assemble the noise maker 10.

Figure 4C:
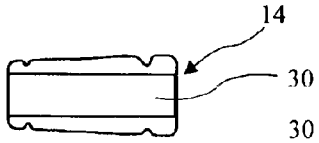
FIG. 4C is a cross-sectional view of the blow tube taken along line 4C—4C of FIG. 4A.
Figure 4D:
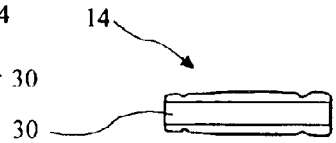
FIG. 4D is a cross-sectional view of the blow tube taken along line 4D—4D of FIG. 4B.

Cross-sectional views taken along line 4C—4C of FIG. 4A and along line 4D—4D of FIG. 4B show a tube passageway 30 extending through the blow tube 14 between the mouth end 20 and the tongue end 22 in FIGS. 4C and 4D. The tube passageway 30 at the mouth end 20 is preferably between one eighth inches and five sixteenths inches high, and is preferably between three eighths inches and one half inches wide.

Figure 4E:
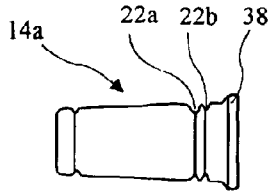
FIG. 4E is a cross-sectional view of a second embodiment the blow tube with a tongue flange taken along line 4C—4C of FIG. 4A.

A cross-sectional view taken along line 4C—4C of FIG. 4A, of second embodiment of a blow tube 14*a* with a tongue flange 38 and a second tongue groove 22*b* is shown in FIG. 4E. The tongue flange 38 helps retain the tongue 12 on the blow tube 14, and the tongue groove 22*b* provides a channel for retaining adhesive during the assembly process of the tongue 12 to the blow tube 14.

Figure 5:
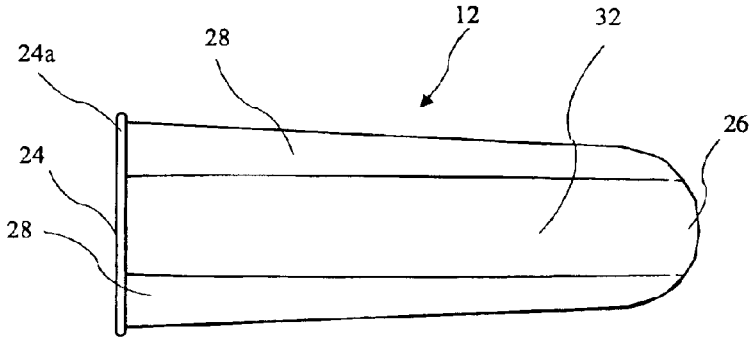
FIG. 5 is a top view of the tongue showing attachment regions of the tongue.

A more detailed view of the tongue 12 is shown in FIG. 5, showing attachment regions 28. The tongue 12 is preferably constructed by bonding two pieces of a flaccid material, for example rubber, together, which bonding is in the attachment regions 28, or by molding the tongue 12 using a slide to produce the tongue passage 32, preferably leaving a three eighths inch to a three quarter inch wide gap between the attachment regions 28, thereby forming a tongue passage 32. The tongue 12 may further include a tube end ridge 24*a* providing structural strength to the tube end 24 of the tongue 12, wherein the tube end ridge 24*a* provides an improved grip between the tongue 12 and the blow tube 14.

Figure 6:
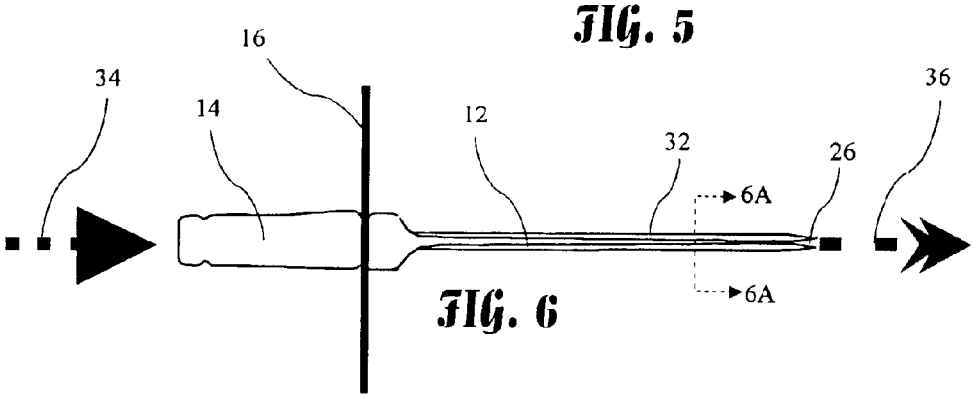
FIG. 6 depicts the flow of air through the blow tube and tongue when the noise maker is in use.
Figure 6A:
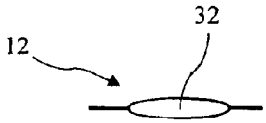
FIG. 6A is a cross-sectional view of the blow tube taken along line 6A—6A of FIG. 6.

A first air flow 34 is shown entering the blow tube 14, and a second air flow 36 is shown leaving the open end 26 of the tongue 12 in FIG. 6. The tongue passage 32 is seen to slightly bulge when air is blown into the blow tube 14. A cross-sectional view taken along line 6A—6A of FIG. 6 is shown in FIG. 6A, wherein the tongue passage 32 is shown in a bulged state due to air being blown into the blow tube 14.

Figure 7:
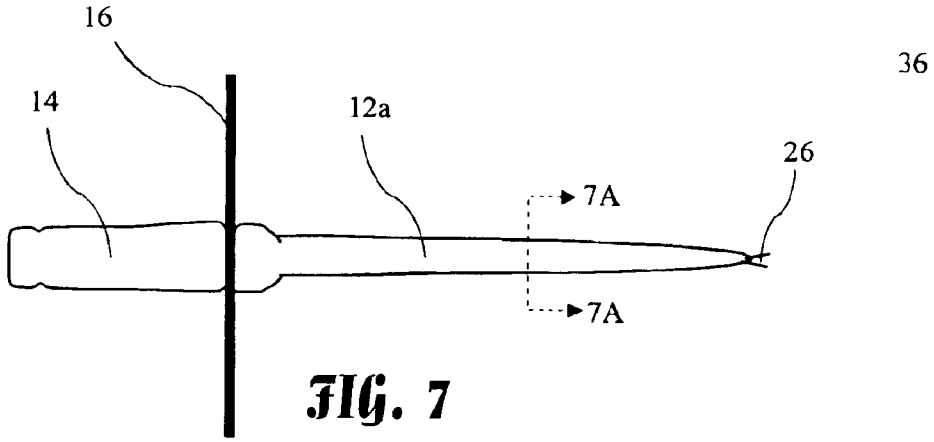
FIG. 7 shows a thick tongue.
Figure 7A:
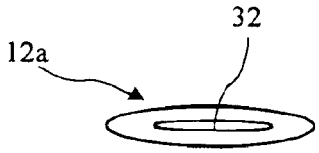
FIG. 7A is a cross-sectional view of the thick tongue taken along line 7A—7A of FIG. 7.

A thick tongue 12*a* is shown in FIG. 7. The thick tongue is preferably made by molding using a slide to produce the tongue passage 32 (see FIG. 5). A cross-sectional view of the thick tongue 12*a*, taken along line 7A—7A of FIG. 7 is shown in FIG. 7A. Other than thickness, the tongue 12*a* preferably has the same dimensions as the tongue 12 described in FIG. 1.

Figure 8A:
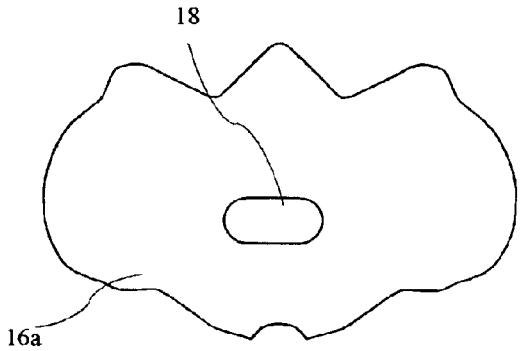
FIG. 8A depicts a first face piece with a shape suitable for displaying a clown face, monster face, cartoon character face, or the like face or mouth portion of a face.
Figure 8B:
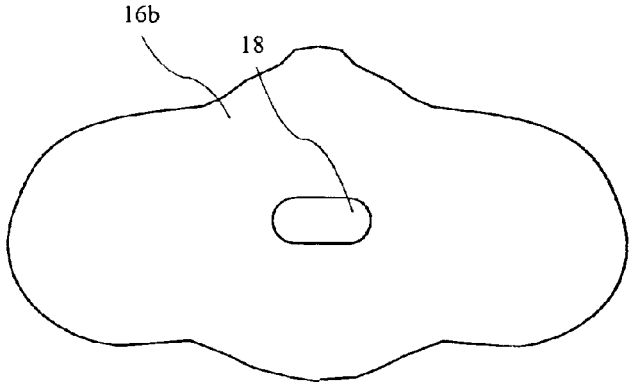
FIG. 8B depicts a second face piece with a shape suitable for displaying a clown face, monster face, cartoon character face, or the like face or mouth portion of a face.
Figure 8C:
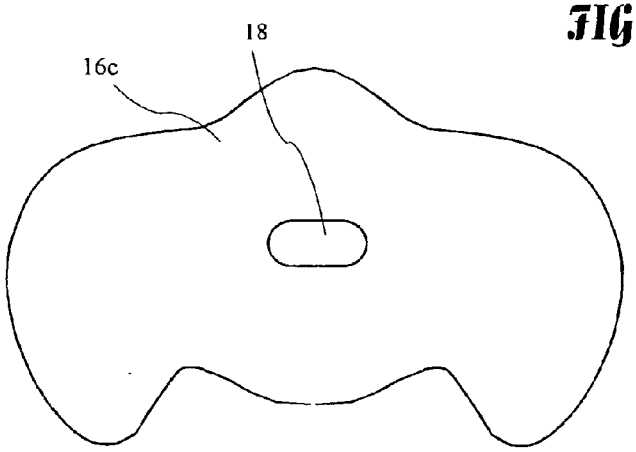
FIG. 8C depicts a third face piece with a shape suitable for displaying a clown face, monster face, cartoon character face, or the like face or mouth portion of a face.

In a preferred use, the face piece 16 is presented with a clown face, monster face, cartoon character face, or the like face, or mouth portion, or mouth and nose portion, or mouth, nose, and chin portion of such face, thereon. To facilitate the presentation of such faces, the face piece 16 may be shaped consistently with the face. For example, the face piece 16 may be a first face piece 16*a* as shown in FIG. 8A, a second face piece 16*b* as shown in FIG. 8B, or a third face piece 16*c* as shown in FIG. 8C. The examples shown herein are merely three of a multiplicity of faces, and any face like noise maker with a flat tongue and blow tube inserted into a face piece of any shape is intended to come within the scope of the present invention.

Figure 8D:
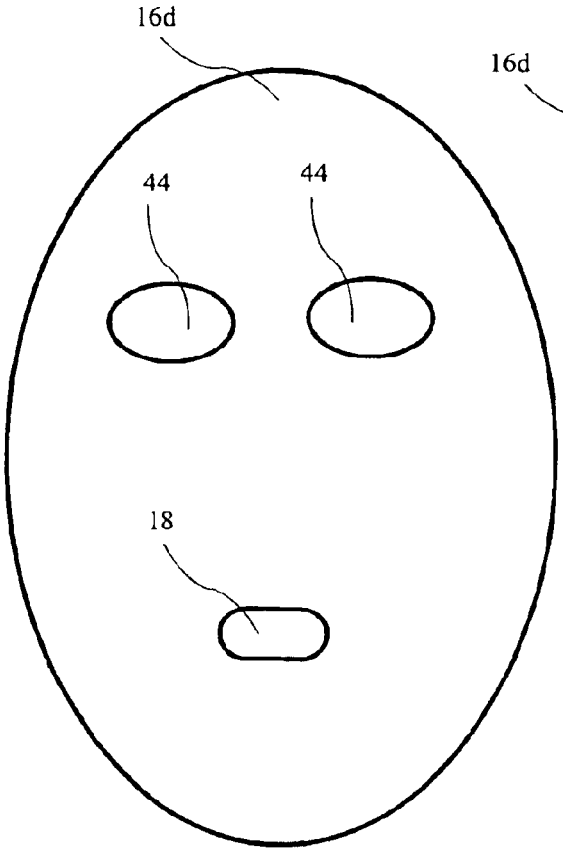
FIG. 8D is a full face piece of the present invention.
Figure 8E:
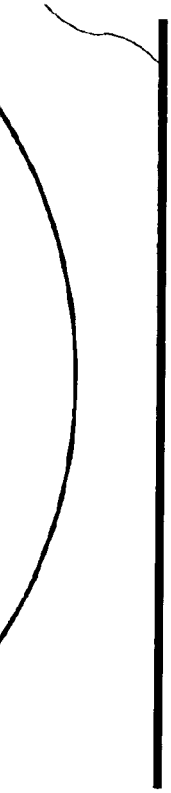
FIG. 8E is a side view of a flat embodiment of the full face piece.
Figure 8F:
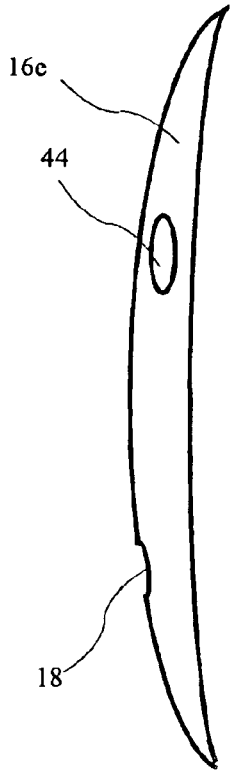
FIG. 8F is a side view of a three dimensional (or contoured) full face piece of the present invention.

A full face piece 16*d* is shown in front view in FIG. 8D and in side view in FIG. 8E. The face piece 16*d* includes the opening 18, and additionally includes eye holes 44. The face piece 16*d* may be flat, or may be a three dimensional (i.e., contoured) full face piece 16*e* as shown in FIG. 8F. The full face pieces 16*d*, 16*e* are preferably between eight and eleven inches high, and between six and eight inches wide. Although the face piece 16 is described above in a flat embodiment, the face piece 16 may contoured as the face piece 16*e*.

Figure 9:
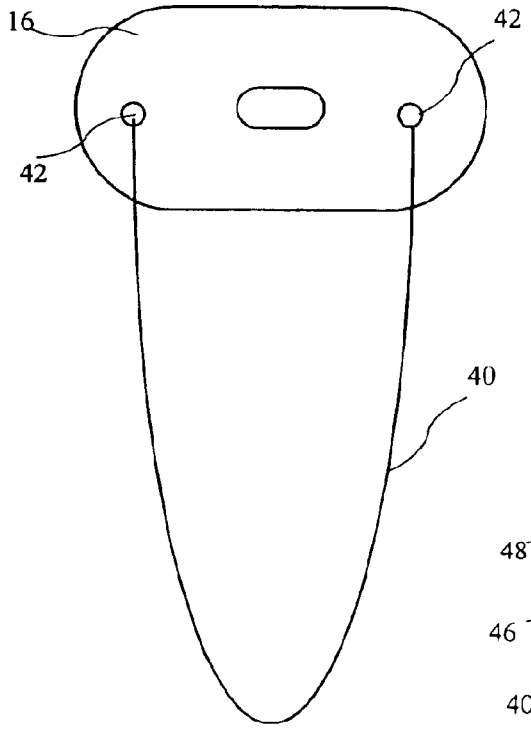
FIG. 9 shows a face piece with a lanyard attached by lanyard snaps.

A face piece 16 with a lanyard 40 preferably attached by lanyard snaps 42, and more preferably by plastic lanyard snaps is shown in FIG. 9.

Figure 10:
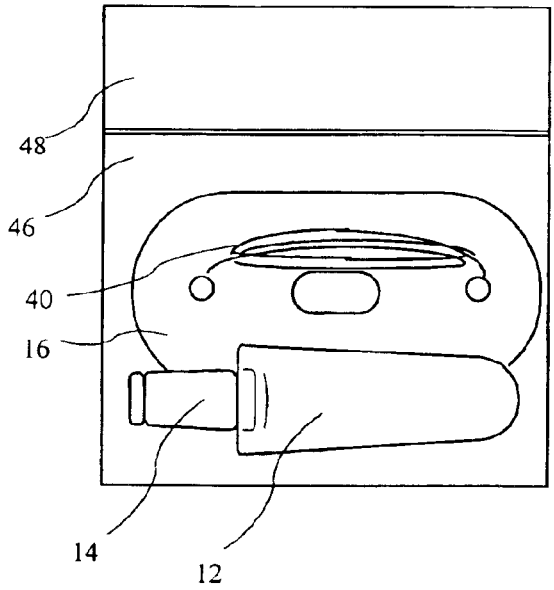
FIG. 10 is a packaged noise maker according to the present invention.

A retail packaging 46 having a label 48 is shown in FIG. 10. The face piece 16, blow tube 14, tongue 12, and lanyard 40 are contained in the packaging 46.

While the invention herein disclosed has been described by means of specific embodiments and applications thereof, numerous modifications and variations could be made thereto by those skilled in the art without departing from the scope of the invention set forth in the claims.

I claim:

1. A noisemaker comprising:

a face piece;

a blow tube extending inwardly from the face piece and having a mouth end opposite the face piece, a tongue end proximal to the face piece, and a tube passageway extending through the blow tube between the mouth end and the tongue end; and a tongue extending outwardly from the face piece and having an open end opposite the face piece, a tube end proximal to the face piece, and a tongue passageway running from the tube end to the open end, wherein suitably blowing through the blow tube causes a raspberry sound to be produced at the open end of the tongue.

2. The noise maker of claim 1, wherein the tongue is a flat tongue.

3. The noise maker of claim 1, wherein the tongue is a thick tongue.

4. The noise maker of claim 1, wherein the face piece is substantially planar.

5. The noise maker of claim 1, wherein the face piece is contoured.

6. The noise maker of claim 1, wherein the face piece is between 2.5 inches and 5.5 inches high, and between three and 5.5 inches wide.

7. The noise maker of claim 1, wherein the face piece is a full face piece between eight inches and eleven inches high, and between six and eight inches wide.

8. The noise maker of claim 1, wherein the face piece has an opening providing an interference fit to the tongue end of the blow tube inserted therethrough.

9. The noise maker of claim 1, wherein the blow tube has a tongue end groove proximal to the tongue end, and wherein the tongue end groove cooperates with an opening in the face piece to snap the blow tube into the face piece.

10. The noise maker of claim 1, wherein a lanyard is attached to the face plate.

11. The noise maker of claim 1, wherein:

the blow tube is between one inch and two inches long;

the tube passage at the mouth end is between one eighth inches and five sixteenths inches high, and is between three eighths inches and one half inches wide; and the tongue end of the blow tube is between one quarter inches and one half inches high, and is between three quarters inches and one inch wide.

12. The noise maker of claim 1, wherein the blow tube includes a mouth piece at the mouth end.

13. The noise maker of claim 1, wherein:

the tongue is between two inches and four inches long;

the tube end of the tongue is between 1.25 inches and 2.25 inches wide; and the tongue open end is rounded having a radius of between 0.75 inches and 1.25 inches.

14. The noise maker of claim 1, wherein the tongue is constructed from rubber.

15. The noise maker of claim 14, wherein the tongue is constructed from bonding two layers of rubber together along edges of the two layers, and leaving a three eights inch to a three quarter inch wide gap between the bonded edges.

16. The noise maker of claim 1, wherein the tube end of the tongue is affixed to the tongue end of the blow tube.

17. The noise maker of claim 16, wherein:

the tongue end of the blow tube is an approximately one quarter inch long portion at the tongue end of the blow tube; and the tube end of the tongue is affixed to the tongue end of the blow tube wherein the tongue end of the blow tube is substantially covered by the tube end of the tongue.

18. The noise maker of claim 16, wherein the affixed blow tube and tongue are inserted into an opening in the face piece to construct the noise maker.

19. A packaged noise maker comprising:

a packaging for retail sales;

a face piece having an opening;

a blow tube having a mouth end opposite a tongue end, and a tube passageway extending through the blow tube between the mouth end and the tongue end; and a substantially flat tongue having an open end opposite a tube end, and a tongue passageway running from the tube end to the open end, wherein:

the tube end of the tongue is affixed to the tongue end of the blow tube, and the affixed tongue and blow tube are insertable into the opening in the face piece to assemble the noise maker; and suitably blowing through the blow tube causes a raspberry sound to be produced at the open end of the tongue.

20. The packaged noise maker of claim 19, wherein:

the face piece is between 2.5 inches and 5.5 inches high, and between three and 5.5 inches wide;

the blow tube is between one inch and two inches long;

the tube passage at the mouth end is between one eighth inches and five sixteenths inches high, and is between three eighths inches and one half inches wide;

the tube passage at the tongue end is between one quarter inches and one half inches high, and is between three quarters inches and one inch wide;

the tongue is between two inches and four inches long;

the tube end of the tongue is between 1.25 inches and 2.25 inches wide; and the tongue open end is rounded having a radius of between 0.75 inches and 1.25 inches.

21. The packaged noise maker of claim 20, wherein the tongue is constructed by bonding two layers of rubber together along edges of the two layers, and leaving a three eighths inch to a three quarter inch wide gap between the bonded edges.

22. An assemblable noise maker comprising:

a face piece having an opening;

a blow tube having a mouth end, a tongue end opposite the mouth end, and a tube passageway extending through the blow tube between the mouth end and the tongue end; and a substantially flat tongue having an open end opposite the face piece, a tube end proximal to the face piece, and a tongue passageway running from the tube end to the open end, wherein:

the tube end of the tongue is attached to the tongue end of the blow tube;

the face piece opening provides an interference fit to the tongue end of the blow tube suitable for holding the blow tube in the opening; and blowing through the blow tube causes a raspberry sound to be produced at the open end of the tongue.

23. The packaged noise maker of claim 22, wherein:

the face piece is between 2.5 inches and 5.5 inches high, and between three and 5.5 inches wide;

the blow tube is between one inch and two inches long;

the tube passage at the mouth end is between one eighth inches and five sixteenths inches high, and is between three eighths inches and one half inches wide;

the tube passage at the tongue end is between one quarter inches and one half inches high, and is between one half inches and one inch wide;

the tongue is between two inches and four inches long;

the tube end of the tongue is between 1.25 inches and 2.25 inches wide; and the tongue open end is rounded having a radius of between 0.75 inches and 1.25 inches.

24. The packaged noise maker of claim 23, wherein the tongue is constructed by bonding two layers of rubber together along edges of the two layers, and leaving a three eights inch to a three quarter inch wide gap between the bonded edges.

25. A noise maker comprising:

a face piece a blow tube having a mouth end opposite a tongue end, and a tube passageway extending through the blow tube between the mouth end and the tongue end; and a tongue having an open end opposite a tube end, and a tongue passageway running from the tube end to the open end, wherein:

the blow tube has a tongue end groove proximal to the tongue end, and wherein the tongue end groove cooperates with an opening in the face piece to snap the blow tube into the face piece;

the blow tube is between one inch and two inches long;

the tube passage at the mouth end is between one eighth inches and five sixteenths inches high, and is between three eighths inches and one half inches wide;

the tongue end of the blow tube is between one quarter inches and one half inches high, and is between three quarters inches and one inch wide;

the tongue is between two inches and four inches long;

the tube end of the tongue is between 1.25 inches and 2.25 inches wide; and the tongue open end is rounded having a radius of between 0.75 inches and 1.25 inches; and suitably blowing through the blow tube causes a raspberry sound to be produced at the open end of the tongue.

26. The noise maker of claim 25, wherein the tongue includes laterally extending flanged surfaces proximal to the tube end of the tongue, wherein the flanged surfaces provide a full tongue width appearance to the entire tongue.

* * * * *